US008490215B2

(12) United States Patent
Mueller et al.

(10) Patent No.: US 8,490,215 B2
(45) Date of Patent: Jul. 23, 2013

(54) REINFORCING ELEMENT

(75) Inventors: Detlef Mueller, Auerbach (DE); Dirk Meythaler, Nürnberg (DE)

(73) Assignee: adidas International Marketing B.V., Amsterdam (NL)

( * ) Notice: Subject to any disclaimer, the term of this patent is extended or adjusted under 35 U.S.C. 154(b) by 1633 days.

(21) Appl. No.: 11/392,251

(22) Filed: Mar. 29, 2006

(65) Prior Publication Data

US 2006/0253951 A1 Nov. 16, 2006

(30) Foreign Application Priority Data

Mar. 30, 2005 (DE) ..... 10 2005 014 470

(51) Int. Cl.
*A41D 13/08* (2006.01)

(52) U.S. Cl.
USPC ..... 2/21; 2/161.1; 2/161.6; 2/163

(58) Field of Classification Search
USPC ..... 2/16, 20, 21, 159, 160, 161.1, 161.5, 2/161.6, 163, 164, 166; 602/5, 22, 3, 16, 602/20, 21; 128/880, 846, 878, 881
See application file for complete search history.

(56) References Cited

U.S. PATENT DOCUMENTS

| | | | | |
|---|---|---|---|---|
| 991,036 | A | | 5/1911 | Spiegelman |
| 1,586,698 | A | | 6/1926 | Posner |
| 1,951,190 | A | | 3/1934 | Gambee |
| 2,251,551 | A | | 8/1941 | O'Reilly |
| 2,302,694 | A | | 11/1942 | Jennings |
| 3,707,730 | A | | 1/1973 | Slider |
| 3,732,575 | A | | 5/1973 | Pakulak |
| 3,838,853 | A | | 10/1974 | Fredenhagen |
| 4,051,553 | A | | 10/1977 | Howard |
| 4,187,620 | A | | 2/1980 | Selner |
| 4,253,660 | A | | 3/1981 | Tiktin |
| 4,272,849 | A | | 6/1981 | Thurston et al. |
| 4,354,280 | A | * | 10/1982 | Hayes ..... 2/16 |
| 4,366,634 | A | | 1/1983 | Giese et al. |
| 4,368,883 | A | | 1/1983 | Tiktin |
| RE31,538 | E | | 3/1984 | Antonious |
| 4,441,213 | A | | 4/1984 | Trumble et al. |

(Continued)

FOREIGN PATENT DOCUMENTS

| | | |
|---|---|---|
| CH | 577 328 | 7/1976 |
| CH | 87 06 816.8 | 8/2007 |

(Continued)

OTHER PUBLICATIONS

Copies of three photos of adidas, "Fingersave Glove".

(Continued)

*Primary Examiner* — Khoa Huynh
*Assistant Examiner* — Sally Haden
(74) *Attorney, Agent, or Firm* — Kilpatrick Townsend & Stockton LLP

(57) ABSTRACT

The invention relates to a reinforcing element for an article of clothing, in particular for a goalkeeper glove, that allows a bending in a first direction, but resists bending in a second direction. The reinforcing element includes at least one bending area that has a curvature with a shape that allows bending of the reinforcing element in the first direction and blocks a bending of the reinforcing element in the second direction.

18 Claims, 4 Drawing Sheets

U.S. PATENT DOCUMENTS 4,489,716 A * 12/1984 Blackwood et al. ..... 602/20
4,507,804 A 4/1985 Consigny
4,524,464 A 6/1985 Primiano et al.
4,561,122 A 12/1985 Stanley et al.
4,565,195 A 1/1986 Eisenberg
4,570,269 A * 2/1986 Berlese ..... 2/16
4,663,783 A 5/1987 Obayashi
4,680,812 A 7/1987 Weigl
4,691,387 A 9/1987 Lopez
4,698,851 A 10/1987 Dunford et al.
4,738,447 A 4/1988 Brown
4,742,579 A 5/1988 Dunford
4,766,612 A 8/1988 Patton, Sr.
4,776,111 A 10/1988 Crowley
4,779,289 A 10/1988 Prouty
4,787,376 A 11/1988 Eisenberg
4,815,147 A 3/1989 Gazzano et al.
4,864,659 A 9/1989 Morris
4,865,023 A 9/1989 Craythorne et al.
4,884,561 A 12/1989 Letson, Sr.
4,911,433 A 3/1990 Walker et al.
4,922,630 A 5/1990 Robinson
4,930,162 A 6/1990 Côté
4,958,384 A 9/1990 McCrane
4,995,119 A 2/1991 Codkind
4,999,847 A * 3/1991 Barcelo ..... 2/24
5,018,221 A 5/1991 Romandetto
5,033,119 A 7/1991 Wiggins
5,050,319 A 9/1991 Perotto et al.
5,056,509 A 10/1991 Swearington
5,067,175 A 11/1991 Gold
5,078,128 A 1/1992 Grim et al.
5,083,314 A 1/1992 Andujar
D323,910 S 2/1992 Pierce, Jr.
5,107,544 A 4/1992 Capatosto
5,125,171 A 6/1992 Stewart
5,133,775 A 7/1992 Chen
5,136,725 A 8/1992 Montero
5,140,995 A 8/1992 Uhl
5,152,082 A 10/1992 Culpepper
5,175,947 A 1/1993 Parracho
5,222,256 A 6/1993 Wang
5,257,418 A 11/1993 Jaskiewicz
5,267,677 A 12/1993 Nash
5,295,269 A 3/1994 Ballard
5,307,521 A 5/1994 Davis
5,330,391 A 7/1994 Mitchell
5,358,469 A 10/1994 Patchel et al.
5,456,650 A 10/1995 Williams, Jr. et al.
5,486,157 A 1/1996 DiBenedetto
5,511,242 A 4/1996 Bianchi
5,511,243 A 4/1996 Hall et al.
5,551,083 A 9/1996 Goldsmith
5,557,803 A 9/1996 Granich et al.
5,594,954 A * 1/1997 Huang ..... 2/24
5,628,069 A 5/1997 Ebert
5,640,712 A 6/1997 Hansen et al.
5,741,222 A 4/1998 Fiore
5,758,365 A 6/1998 Steeley
5,768,710 A 6/1998 Williams
5,768,717 A 6/1998 Le Sueur
5,774,896 A 7/1998 Hochmuth
5,774,897 A 7/1998 Hochmuth
5,792,087 A 8/1998 Pringle
5,799,659 A 9/1998 Stano
5,802,614 A 9/1998 Melone, Jr.
5,809,571 A 9/1998 Spitzer
5,810,754 A 9/1998 Kenosh
5,815,838 A 10/1998 Lord et al.
5,848,440 A 12/1998 Pajarola
5,881,385 A 3/1999 Hochmuth
5,884,329 A 3/1999 Goldsmith et al.
5,894,684 A 4/1999 Sand et al.
5,896,683 A 4/1999 Foxen et al.
5,898,943 A 5/1999 Kim
5,933,868 A 8/1999 Bender
5,937,444 A 8/1999 Hochmuth
5,946,720 A 9/1999 Sauriol
5,963,985 A 10/1999 Behr et al.
5,974,588 A 11/1999 Furman
5,983,396 A 11/1999 Morrow et al.
6,012,170 A 1/2000 Kim
6,024,712 A 2/2000 Iglesias et al.
6,029,376 A 2/2000 Cass
6,083,184 A 7/2000 Kenosh
6,088,835 A 7/2000 Perkins et al.
6,112,434 A 9/2000 Seltzer et al.
6,119,271 A * 9/2000 Byon ..... 2/161.2
D436,148 S 1/2001 Villepigue
6,223,350 B1 5/2001 McFarlane
6,279,163 B1 8/2001 Hale et al.
6,342,043 B1 1/2002 Gottsmann et al.
D454,231 S * 3/2002 McFarlane ..... D29/121.1
6,415,443 B1 7/2002 Schierenbeck et al.
6,427,695 B1 8/2002 Zanetti et al.
6,557,177 B2 * 5/2003 Hochmuth ..... 2/159
6,687,920 B2 2/2004 Berns
6,715,218 B2 4/2004 Johnson
6,725,466 B2 * 4/2004 Hochmuth ..... 2/161.1
D504,981 S * 5/2005 Vanderhoef ..... D29/121.1
6,918,137 B2 * 7/2005 Fowler ..... 2/16
D521,644 S * 5/2006 Nordt et al. ..... D24/190
7,143,447 B2 12/2006 Fleischmann
7,293,296 B1 * 11/2007 Beraznik et al. ..... 2/161.1
7,313,831 B2 1/2008 Wilder et al.
7,320,145 B2 1/2008 Hochmuth
7,329,230 B2 2/2008 Mazzarolo
7,451,493 B2 * 11/2008 Godshaw ..... 2/24
2002/0073477 A1 6/2002 Hochmuth
2002/0184696 A1 12/2002 Hochmuth
2004/0148675 A1 8/2004 Powell
2005/0114982 A1 * 6/2005 Gremmert ..... 2/159
2005/0153153 A1 * 7/2005 Saur et al. ..... 428/542.8
2006/0026738 A1 * 2/2006 Kleinert ..... 2/163
2006/0048259 A1 * 3/2006 Keppler et al. ..... 2/21
2007/0028354 A1 2/2007 Hochmuth
2007/0226866 A1 10/2007 Geyer et al.
2007/0261149 A1 11/2007 Gait
2008/0263745 A1 10/2008 Grilliot et al.
2008/0271219 A1 * 11/2008 Homer ..... 2/21
2009/0172864 A1 7/2009 Fisher et al.
2009/0222967 A1 9/2009 Winningham et al.

FOREIGN PATENT DOCUMENTS

DE 28 53 154 8/1980
DE 35 16 545 5/1985
DE 87 08 682.4 9/1987
DE 37 25 516 9/1988
DE 37 38 005 5/1989
DE 89 10 050.6 12/1989
DE 297 05 586 8/1998
DE 298 08 682 9/1999
DE 299 16 217 5/2000
DE 199 10 799 8/2000
DE 100 10 403 9/2001
DE 100 10 404 9/2001
DE 201 13 431 2/2002
DE 101 00 848 8/2002
DE 201 07 098 10/2002
EP 0 083 454 7/1983
HU 24401/99 6/1999
JP 09262332 10/1997
WO WO 99/23981 5/1999
WO WO 00/53275 9/2000
WO WO 01/00052 1/2001

OTHER PUBLICATIONS

Copies of five photographs of a reinforcing element utilized in adidas "Fingersave Glove" (Ref. C1) (components partially separated). Opposition request filed in corresponding European Patent No. EP 1 527 802 B1, 6 pages.

* cited by examiner

REINFORCING ELEMENT

CROSS-REFERENCE TO RELATED APPLICATION

This application claims priority to and the benefit of, German Patent Application Serial No. 102005014470.5, filed on Mar. 30, 2005, the entire disclosure of which is hereby incorporated by reference herein.

TECHNICAL FIELD

The present invention relates to a reinforcing element for an article of clothing, in particular, for a soccer goalkeeper glove that allows bending in a first direction, but resists bending in a second direction.

BACKGROUND OF THE INVENTION

Apart from thermal isolation, gloves typically serve to protect the hands. Injuries are avoided by blocking or at least cushioning mechanical impacts to the hand. For example, work gloves are typically made from stable and tear-resistant materials to reduce the risk of cuts to the hand.

A goalkeeper glove, for example, fulfills several requirements. Apart from improving the grip on the inner side of the hand, it is important to protect the hand against the significant mechanical loads arising when deflecting a sharply shot ball. A particular risk for a goalkeeper is the hyperextension of individual fingers or the thumb. When a goalkeeper tries to deflect a ball with an extended hand, there is the risk that one or two fingers of the extended hand, which barely contact the ball, are subjected to the full impact of the ball and hyperextended. Straining or even breaking a finger or the hand is a possible consequence. It has, therefore, been known to provide goalkeeper gloves and gloves for sports (e.g., snowboard gloves), where the hand is subjected to similar loads, with active reinforcing elements. These reinforcing elements allow for bending of the hand in a gripping direction, but they block a bending of the extended hand into the opposite direction, i.e., in the direction of a hyperextension. In the case of a goalkeeper glove, the extended hand and in particular individual fingers and the thumb are actively supported by the glove when deflecting a sharply shot ball.

To obtain the desired mechanical properties it is known from German Patent No. DE 35 16 545 C2, the entire disclosure of which is hereby incorporated herein by reference, to manufacture the backside of a glove in certain areas out of two layers. A series of compression-proof bodies are arranged on a flexible, but non-yielding first layer (for example a suitable foil). A glove having such a backside can be right away bent, since the first, flexible layer does not provide any significant resistance against such a deformation. If the hand and the glove are extended, however, the compression-proof bodies of the second layer contact each other. The compression-proof bodies, together with the non-yielding nature of the first layer, prevent the backside of the glove from being bent in a direction of hyperextension, i.e., beyond the extended configuration.

A different approach is known from German Utility Model No. DE 201 13 431 U1, the entire disclosure of which is hereby incorporated herein by reference. A glove reinforcing element is disclosed comprising a plurality of hingedly connected parts, each of which have a rotation pin and at the other end a corresponding bearing cavity. The links are designed such that a rotation of two links is only possible in one direction and the link chain blocks a movement in the opposite direction beyond the extended configuration.

A further design is shown in German Patent Application No. DE 100 10 404 A1, the entire disclosure of which is hereby incorporated herein by reference. The glove reinforcing element disclosed in this document comprises a plurality of links that are threaded onto a pulling organ extending through the links. This arrangement is similar to the design of the backside of the glove disclosed in DE 35 16 545 C2, wherein the pulling organ, for example a wire, has the function of the first, non-yielding layer.

Glove reinforcing elements known from the prior art for active protection against hyperextension are, however, difficult to manufacture. In the designs explained above, the compression-proof bodies of the second layer first have to be reliably anchored on the non-yielding first layer, for example by gluing or sewing or by guiding the pulling organ through openings in each of the compression-proof bodies. This process is difficult to automate.

The same applies to reinforcing elements made from a plurality of hingedly connected links. In a first step, each link must be manufactured. Subsequently, all links have to be interconnected. Since up to ten reinforcing elements are needed for a complete protection of the hands, this will lead to a significant manufacturing effort and resulting costs. As a consequence, gloves providing active protection against hyperextension can until now only be found in high-priced gloves for (semi-) professional users. In particular, it is impossible to produce gloves with a protection against hyperextension for kids at a cost that would be accepted by the market, although kids have the greatest risk of injuries.

A further disadvantage is the comparatively greater weight of gloves having a backside as described in DE 35 16 545 C2. The same applies to gloves having other known reinforcing elements. As a result, the movements of the goalkeeper become slower and the wearer cannot react quickly to a surprise shot.

Furthermore, known glove reinforcing elements are typically uncomfortable and create pressure points on the backside of the finger and/or the hand, for example when a ball is deflected using the fist, so that a very high load acts locally on the reinforcing element. Glove manufacturers try to avoid this effect by providing complex cushioning; however, such complex cushioning further increases the price, renders the glove bulky, and leads to a less direct support function of the glove reinforcing element. Moreover, the use of a plurality of compression-proof bodies or hinges makes it difficult to control the ball when deflecting with the fist, so that the ball is often deflected in an uncontrolled manner.

In a completely different technical field, i.e., the manufacture of soccer boots, it is known from German Patent Application No. DE 27 32 463, the entire disclosure of which is hereby incorporated herein by reference, to integrate a curved reinforcing insert into the shoe sole, which allows a bending of the shoe during rolling-off, but which stabilizes the shoe when shooting a ball.

There is, therefore, a need to provide a reinforcing element that protects against hyperextension, overcomes at least some of the above mentioned disadvantages of the prior art, and can be manufactured at a low cost.

SUMMARY OF THE INVENTION

This problem is solved by a reinforcing element, in particular for a goalkeeper glove, that allows a bending in a first direction, but avoids a hyperextension of a joint of a wearer, in an opposite direction. The reinforcing element includes at least one bending area that corresponds to the wearer's joint when worn. The bending area has a curvature with a shape that allows bending in a first direction and blocks a bending in a second direction.

A reinforcing element in accordance with the invention is based on a fundamentally different mechanical principle than the reinforcing elements used in the prior art. Instead of hingedly connected links or material layers with non-yielding or compression-proof elements, the unidirectional bendability is provided by a suitably shaped curvature of at least one bending area of the reinforcing element.

In a basic embodiment, a reinforcing element in accordance with the invention can be an elongate element having a gutter-shaped component, as such a shape allows bending of the reinforcing element in the direction of the open side of the gutter, but remains rigid when bending into the opposite direction, subject to material failure of the reinforcing element. A gutter-shaped curvature is only arched in one spatial direction and thus shows a curved line in a transverse cross-section (e.g., a part of a circular arc), whereas a longitudinal section through a gutter-shaped curvature shows no curve. Additional embodiments described herein are optional modifications of the basic embodiment for providing anisotropic bending properties of the reinforcing element by a suitably shaped curvature.

A reinforcing element in accordance with the invention can be significantly easier and more cost-efficiently produced than the above described constructions of the prior art. In one embodiment, a unitary part is used, which can be manufactured by injection molding a suitable plastic material. A complicated assembly of individual components is not necessary. Furthermore, a reinforcing element in accordance with the invention can be easily adapted to different sizes by, for example, using different injection molding tools.

In one aspect, the invention relates to a reinforcing element for an article of clothing configured for bending in a first direction and resisting bending in a second direction. The reinforcing element includes at least one elongate element and at least one bending area disposed along a portion of the at least one elongate element. The bending area can include a curvature having a shape that allows a bending of the reinforcing element in the first direction and blocks a bending of the reinforcing element in the second direction.

In a particular embodiment, the bending area is arranged in the region of a joint of, for example, the finger and/or the wrist. Since a bent joint (e.g., wrist or finger joint) forms an upwardly curved outer surface, the reinforcing element can be reliably arranged so that its shape, curved in the same direction, is above or adjacent the joint to be protected without requiring further measures to assure that it remains in this position. The conformation between the shape of the backside of, for example, the finger and/or the hand and the reinforcing element, which is arranged thereon, avoids local pressure points as they occur with the canted reinforcing elements of the prior art. In the case of a glove reinforcing element, the reinforcing element includes a plurality of bending sections that corresponds to a plurality of finger joints.

In various embodiments, the at least one bending area of the reinforcing element has a dome-shaped curvature, i.e., a curvature that is curved in more than one direction. Both a transverse cross-section and a longitudinal cross-section through a dome-shaped curvature leads to a curved cut line. In contrast to a gutter-shaped curvature, a dome-shaped curvature localizes the bending at a predefined position, i.e., along a line extending essentially through the center of the dome-shaped curvature. The bending area can be located in a region of the elongate element that corresponds to a joint of a wearer when worn. Furthermore, the reinforcing element can include a plurality of bending areas located in regions of the elongate element that correspond to a plurality of joints of a wearer when worn. The reinforcing element can further include a substantially rigid interconnection area disposed along a portion of the at least one elongate element adjacent to the at least one bending area. The rigid interconnection area can have a gutter-shaped curvature. In one embodiment, the interconnection area includes at least one stiffening element disposed thereon and configured to resist deformation. In contrast to the bending area, the rigid interconnection area remains substantially rigid in spite of its curvature, regardless in which direction the reinforcing element is bent. The curvature is also advantageous for securing the reinforcing element onto the backside of an area of the body, such as, for example, a finger or a hand.

In addition, the reinforcing element can be configured for use in a glove and have a length suitable to extend substantially from a backside of a wearer's hand to an end of a finger. The reinforcing element can extend beyond the end of the finger. In one embodiment, the reinforcing element can be made as a single piece. The reinforcing element can, however, be made by multi-component injection molding of at least two different plastic materials. For example, a plastic material can be used for the bending areas that has a different elasticity than the material used for the interconnection areas. The reinforcing element can include a suitable material and/or a suitable coating to enable sliding of the reinforcing element within a receptacle of the article of clothing. Reinforcing elements of the prior art are typically maintained in the correct position by permanent gluing or hook and loop type connections; however, by making the reinforcing element of the invention slidable within a receptacle of the article of clothing, the reinforcing element will substantially automatically slide to the correct position within the article of clothing as the joint is flexed.

Moreover, the reinforcing element can include a releasably mounted weight for attachment thereto. In one embodiment, the weight is disposed proximate an end of the reinforcing element. Additionally, the curvature of the at least one bending area can extend laterally around the sides of a wearer's joint. The substantially rigid interconnection area can also include a curvature that extends laterally around the sides of a wearer's body adjacent the joint. These lateral curvatures protect the joint and surrounding areas against injuries from the side, for example, as caused by the hard studs on a football boot of a player. One or both of the bending area and the substantially rigid interconnection area can include at least one aperture defined thereby. Such an aperture, or cut-out, further reduces the weight of the reinforcing element. In addition, the aperture(s) can selectively influence the bending properties in sections of the reinforcing element. The at least one elongate element of the reinforcing element can provide a restoring force when bent in the first direction.

In another aspect, the invention relates to an article of clothing including the afore-mentioned reinforcing element. The article can include a glove and the reinforcing element can be removably disposed within a receptacle of the article of clothing. In one embodiment, the glove includes an element corresponding to a backside of a hand to which the at least one reinforcing element can be releasably attached. The element for the backside of the hand can include a plate to, for example, protect a surface of the backside of the hand against injuries. In one embodiment, the reinforcing element is attached to the element in a releasable manner. Such a glove protects not only against hyperextension, but also against injuries as they may be caused by, for example, the sharp edges of studs that may contact the hands of a goalkeeper during use.

These and other objects, along with advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

In the following, embodiments of the reinforcing element in accordance with the invention are further described with reference to a glove reinforcing element for a goalkeeper glove. It is, however, to be understood that the present invention can also be used for other types of gloves, for example gloves for snowboarding, or other articles of clothing for actions which involve a risk of hyperextension of the various joints, such as individual fingers, the thumb, the overall hand, the wrist, the elbow, the knee, the neck, and the like.

Figure 1:
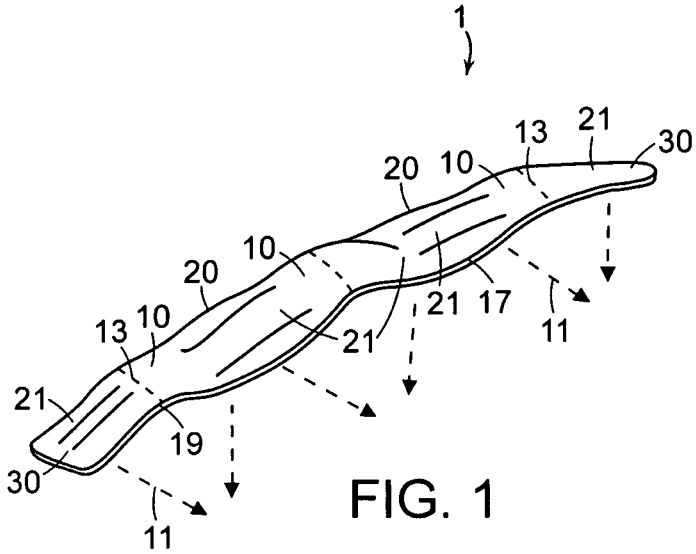
FIG. 1 is a schematic perspective view of a reinforcing element in accordance with one embodiment of the invention.

FIG. 1 presents a perspective view of a single reinforcing element 1. As can be seen, there are three, significantly upwardly curved (e.g., convex) bending areas 10 connected by two interconnecting areas 20. End areas 30 are located at the rear end and the front end of the reinforcing element 1.

As indicated by the dashed arrows 11 in FIG. 1, the bending areas 10 can each be elastically bent and allow a downwardly directed bending of the reinforcing element 1; however, they provide a substantial resistance (subject to material failure) in the case of bending into the opposite direction. The dotted lines 13 in FIG. 1 indicate approximately the buckling line when bending the corresponding bending area 10. It can be seen that these lines each extend approximately through the center of the substantially dome-like bending areas. The shape of the bending area 10, however, only roughly defines the location of the buckling line 13. Therefore, the position of the buckling line 13 can, within certain limits, adapt to the anatomical situation of the joint arranged therebelow (see finger 15 in FIG. 2). The less dome-like the shape of the bending area 10 is, the greater the adaptability of the reinforcing element 1. In the case of an exclusively gutter-shaped curvature, the reinforcing element can be downwardly bent using the same force at any location along the bending area 10.

Interconnecting areas 20 are arranged between the bending areas 10. The interconnecting areas 20 also have a curvature; however, this curvature is typically fully gutter-shaped (i.e., substantially C-shaped in a transverse cross-section) and adapted to the contour of the backside of a finger in sections without joints.

For limiting the bendability of the reinforcing elements to the bending area 10, the interconnecting areas 20 can each be provided with one or more ribs 21. As a result, these sections of the reinforcing element are substantially rigid in spite of their curvature. This property can also be achieved in a different manner by, for example, manufacturing the interconnecting areas 20 from an inelastic material. As explained in further detail below, the reinforcing element 1 in one embodiment can be formed as a single piece; however, using suitable methods it can still be made from different materials. As an alternative to interconnecting areas 20 stiffened by the ribs 21, tube-shaped interconnecting areas 20 could be used to extend over the finger or other body part like a sleeve and, therefore, provide a high degree of stiffness without any further measures. Another possible embodiment uses only one or more reinforcing ribs 21, without a curved interconnecting surface.

In the embodiment shown in FIG. 1, the interconnecting areas 20 extend laterally around the finger (sides 17, see also FIG. 2A) and protect the finger, or other body part, against injuries, for example caused by contacting the hard studs on a football boot of a soccer player or the like. In the bending areas 10, the lateral extension 19 is slightly smaller to allow an easier bending.

The end areas 30 are substantially similar to the interconnecting areas 20; however, it is possible to provide fewer reinforcing ribs 21 on the end areas 30 as compared to the number of ribs 21 on the interconnecting areas 20 (e.g., one rib instead of three ribs, as shown in FIG. 1).

Figure 2A:
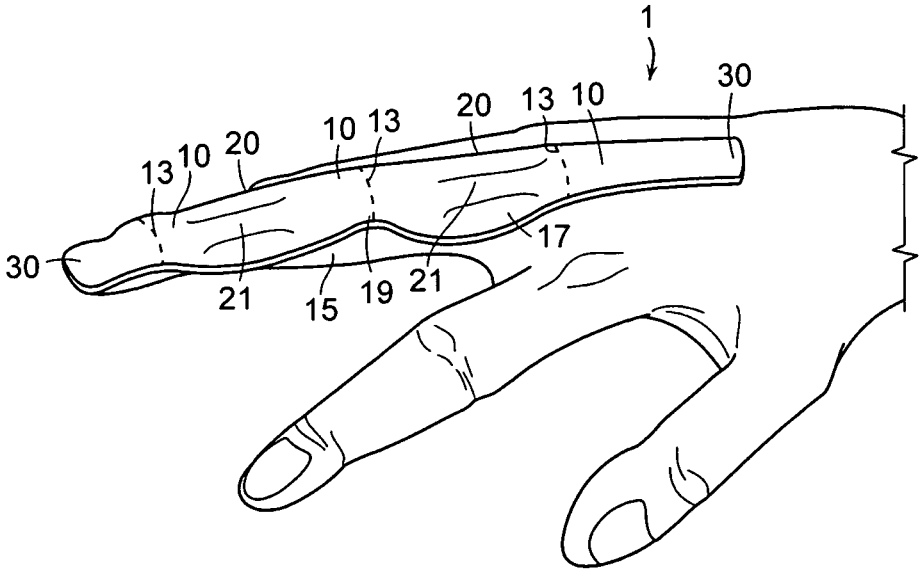
FIG. 2A is pictorial representation of a reinforcing element configured for use in a glove in accordance with one embodiment of the invention and arranged above the backside of a finger as if in the glove.
Figure 2B:
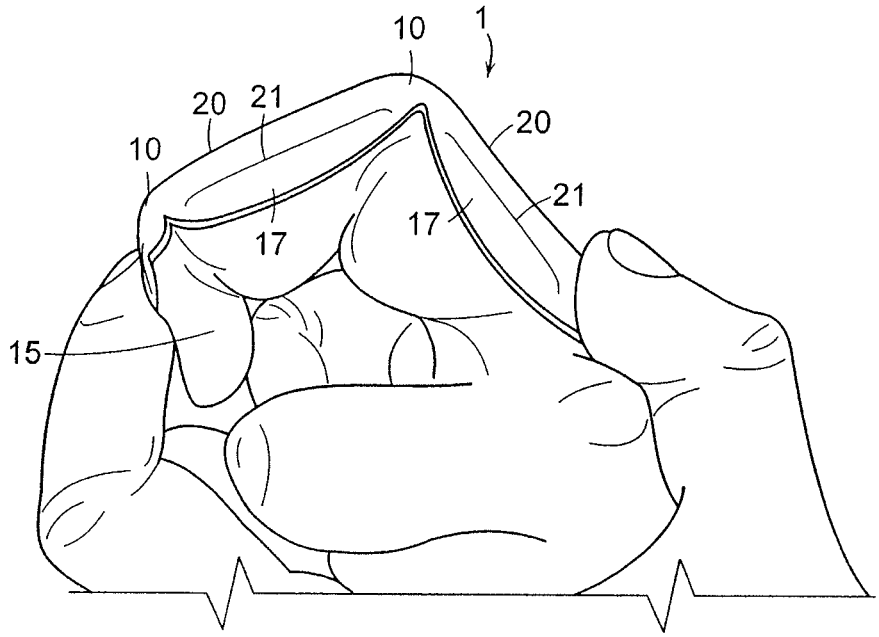
FIG. 2B is a pictorial representation of the reinforcing element of FIG. 2A, as bent in a gripping direction.

FIG. 2A shows pictorially where the reinforcing element 1 shown in FIG. 1 can be arranged relative to the wearer's finger if disposed inside a glove. As can be directly seen, the three bending areas 10 are arranged on top of the three joints of the finger to be protected, whereas the essentially rigid interconnecting areas 20 cover the straight finger bones extending between the joints. FIG. 2B shows the reinforcing element in a bent configuration. As one can see, the elastic bending areas 10 are bent, whereas the substantially rigid interconnecting areas 20 are unchanged. Thus, the reinforcing element 1 adapts itself to the bent contour of the finger. As a result, the reinforcing element 1 has a shape on its inner side that substantially corresponds to the shape of the backside of the finger, so that it "latches" onto the backside of the finger and, therefore, automatically moves into or maintains the correct position relative to the joint(s) to be protected.

To this end, it can be advantageous to manufacture the reinforcing element from a material that easily slides, within certain limits, inside a receptacle (e.g., a pocket) of the glove or other article of clothing. This can, for example, be achieved by coating the reinforcing element 1 with a friction-reducing material, such as the Teflon® (polytetrafluoroethylene (PTFE)) brand sold by DuPont, or a similar substance, and/or by coating an inside surface of the receptacle with such a friction reducing material. Besides coating the reinforcing element 1, it is also possible to compound Teflon® directly into the plastic material used for forming the reinforcing element 1. Other possible materials and manufacturing techniques are described in greater detail hereinbelow. Furthermore, an example of a support device disposed in a pocket on an article of clothing is described in U.S. Pat. No. 6,715,218, the entire disclosure of which is hereby incorporated herein by reference.

Additionally, the good fit of the reinforcing element 1 to the area to be protected due to the sequence of dome-shaped bending areas 10 and the gutter-shaped interconnecting areas 20 leads to a significantly improved wearing comfort compared to the reinforcing elements of the prior art with their hard, typically planar shaped links, which are not adapted to the positioning of the joints in the finger.

In one embodiment, the two end areas 30 extend slightly beyond a topmost end of the finger to be protected and its rear end, respectively. This leads to additional protection for the finger at its front end. For example, when a ball or the like hits the finger from the front side, the arising load is taken up directly by the reinforcing element 1. At the rear end, the extension of the end area 30 causes any hyperextension load to be securely transmitted from the reinforcing element 1 to the overall area of the hand.

FIGS. 2A and 2B show that the upwardly directed upper side (i.e., the outer side) of the reinforcing element 1 has a shape that corresponds substantially (apart from the ribs 21) to the contour of the unprotected finger. This feature facilitates the use of the upper side for deflecting a ball, for example by using the fist. In contrast to known reinforcing elements with a sequence of comparatively thick and hard elements having canted shapes and many edges, the reinforcing element of FIGS. 2A and 2B more easily deflects the ball into a certain direction. If necessary, the stiffening ribs 21 can be covered by a second curved surface on the outside, thereby leading to an almost complete conformation with the typical shape of the backside of a finger, which will further improve control over a deflected ball.

Figure 3:
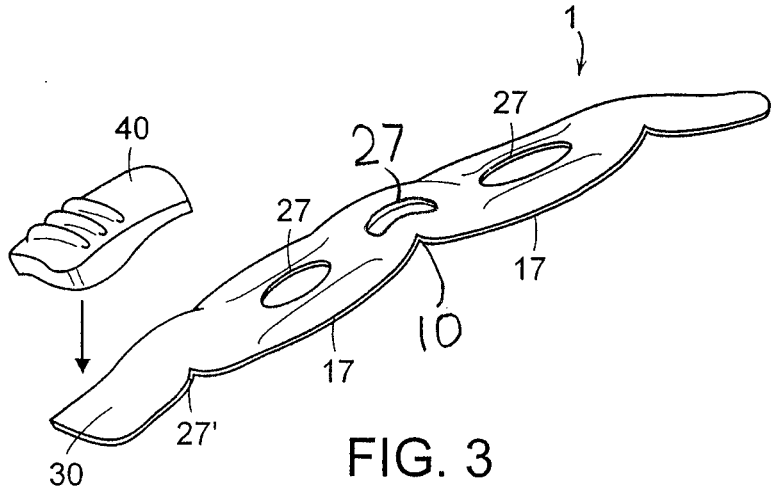
FIG. 3 is a schematic perspective view of a reinforcing element and an attachable weight at one end thereof in accordance with one embodiment of the invention.

FIG. 3 illustrates an additional weight 40 that can be disposed proximate the end area 30 of the reinforcing element 1. The weight 40 can influence the dynamic properties of the article of clothing and, thus, the movements of the wearer. For example, an increased weight at the finger tips leads, due to the arising centrifugal force, automatically to a maximally extended hand configuration when the goalkeeper quickly raises his arms so that he covers the maximum area with his hands.

The weight 40 can be attached to the reinforcing elements in different ways, for example by clipping, screwing, lateral insertion, or other releasable mounting techniques that allow replacement of the weight for another weight of a different mass or to use the reinforcing element 1 without the weight 40. It is, however, also possible to permanently integrate the weight 40 into the receiving element 1. Apart from the arrangement at or in the end area 30, the weight 40 can also be arranged at any other section of the reinforcing element 1. In addition, it is possible to use different weights for different body parts.

Figure 4:
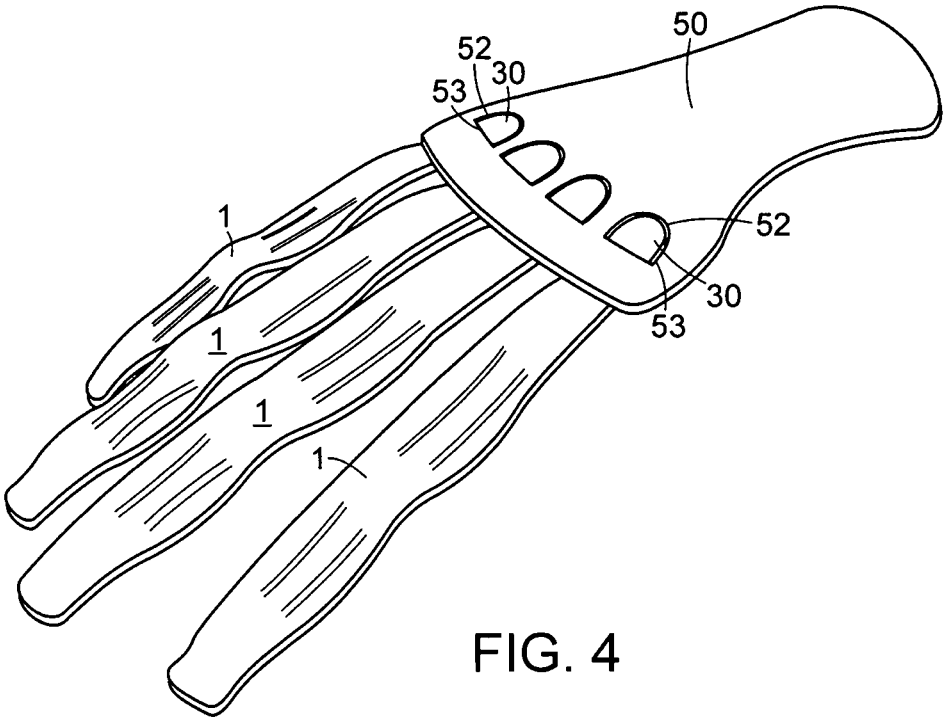
FIG. 4 is a schematic perspective view of a plate for the backside of the hand and a plurality of reinforcing elements releasably attached thereto in accordance with one embodiment of the invention.
Figure 5:
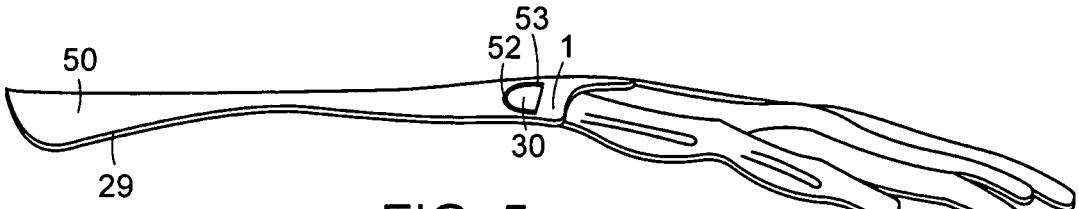
FIG. 5 is a schematic side view of the plate and attached reinforcing elements of FIG. 4.
Figure 6:
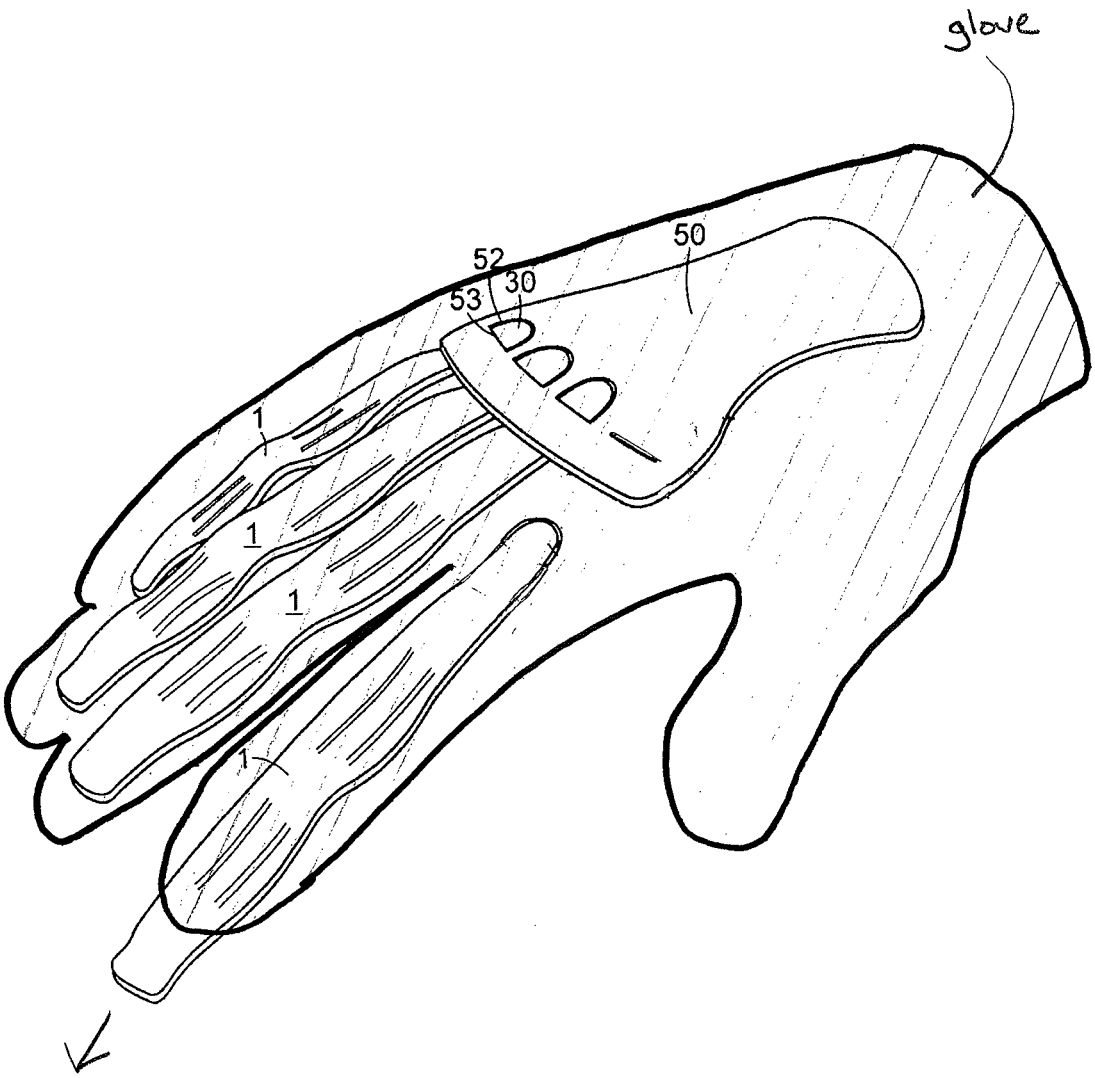
FIG. 6 is a schematic perspective view of an article of clothing, i.e., a glove, featuring a plate for the backside of the hand and a plurality of reinforcing elements releasably attached thereto in accordance with one embodiment of the invention.

FIGS. 4 and 5 illustrate how one embodiment of the reinforcing element 1 can be integrated into a complete protection system inside a glove (see FIG. 6). To this end, there is for each finger and, if necessary, the thumb a reinforcing element 1 that is releasably connected with a plate 50 for the backside of the hand. As already mentioned with respect to the additional weight 40, a number of known attaching methods are suitable for attaching the reinforcing elements 1 to the plate 50. It is desirable for the interconnection to be sufficiently stable to securely transmit the arising loads on an individual reinforcing element 1 into the plate 50 for the backside of the hand. In the embodiment shown in FIGS. 4 and 5, the reinforcing elements 1 are inserted from the front into receptacles 52 that are on their top side closed by a reinforcing ridge 53 that may, if necessary, be provided with suitable latching means. The contact between the rear end area 30 and the receptacle 52 includes a form fit and, thereby, provides the desired stability.

The plate 50 for the backside of the hand may cover substantially the entire backside of the hand and additionally protect the hand from injury from, for example, a player stepping with a studded shoe onto the flat hand of the goalkeeper. As can be seen in the side view of FIG. 5, the plate 50 for the backside of the hand also laterally encompasses the hand (sides 29) in its rear part to provide a good fit and to extend the protection onto the side regions of the hand. The plate 50 may also include a bending area with a curvature in its rear part to protect the wearer's wrist against hyperextension in a similar manner as an individual reinforcing element 1 protects the finger joints.

The reinforcing element 1 can be manufactured as a single plastic part by injection molding or extrusion. Both methods lead to very low manufacturing costs, a low weight, easy adaptation to different sizes, for example for kids gloves, by using correspondingly adapted molds for injection molding. In some embodiments, the single piece reinforcing element can be manufactured by multi-component injection molding more than one plastic material. For example, a harder plastic material can be used for the interconnecting areas 20 and a particularly soft and elastic plastic material can be used for the bending areas 10 to provide a lower bending resistance, in particular for kids' gloves. The multi-component injection molding may be performed simultaneously using one or more nozzles or sequentially. Alternatively, the plastic material can be injected around separately pre-manufactured components of the reinforcing element 1. For example, interconnecting areas 20 made from a sufficiently hard material (for example a metal or a composite material including carbon fiber) may be encompassed by a soft plastic material forming the bending areas 10.

Suitable plastic materials include: thermoplastic polyurethanes (TPU); polypropylene (PP); ethylene vinyl acetate (EVA); thermoplastic polyether block amides, such as the Pebax® brand sold by Elf Atochem; thermoplastic polyester elastomers, such as the Hytrel® brand sold by DuPont; thermoplastic elastomers, such as the Santoprene® brand sold by Advanced Elastomer Systems, L.P.; thermoplastic olefin; nylons, such as nylon 12, which may include 10 to 30 percent or more glass fiber reinforcement; silicones; polyethylenes; acetal; and equivalent materials. Reinforcement, if used, may be by inclusion of glass or carbon graphite fibers or para-aramid fibers, such as the Kevlar® brand sold by DuPont, or other similar method. Also, the polymeric materials may be used in combination with other materials, for example natural or synthetic rubber. Other suitable materials will be apparent to those skilled in the art.

The use of shape memory materials is also possible. Shape memory materials can be brought back into an initial state by applying heat or the like, if the supporting function decreases after some time of use. The very cost efficient manufacture by injection molding, however, allows the reinforcing elements to be used as wearing parts. Reinforcing elements that are permanently bent or no longer sufficiently stable can simply be replaced.

Finally, it is also possible to modify the above explained embodiments by selectively arranging apertures or cut-outs (27 in FIG. 3) in sections of the reinforcing element 1. The cut-outs 27 can influence the bending properties (for example, a notch 27' disposed on a side of a bending area 10 will influence the bending resistance of the reinforcing element) and reduce the overall weight of the reinforcing element 1. The arrangement of cut-outs 27 as well as the material selection and the exact shape of the reinforcing element 1 can vary to suit a particular application and can easily be optimized using a finite-element-analysis. While typically elongate in shape, the reinforcing element 1 can have essentially any shape, such as polygonal, arcuate, or combinations thereof, and will be sized based, at least in part, on the area of the body to be protected and the relative size of the wearer.

In a particular embodiment, the reinforcing element 1 can be arranged in an article of clothing in a detachable manner, which results in a plurality of individual adaptation possibilities. For example, stiffer glove reinforcing elements can be exchanged for softer glove reinforcing elements if a goalkeeper prefers less bending resistance. Besides an individual adaptation of the length, width variations are possible to comply with different body part thicknesses. Additionally, a color adaptation for optical aspects is possible if the reinforcing elements are arranged in transparent pockets on the article of clothing. For example, the reinforcing elements can correspond to certain team or logo colors. Moreover, the releasable arrangement allows the wearer to replace damaged or insufficiently stiff reinforcing elements immediately (e.g., during a game).

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

What is claimed is:

1. A reinforcing element for an article of clothing configured for bending in a first direction and resisting bending in a second direction, the reinforcing element comprising:

at least one elongate element;

a plurality of bending areas disposed along the at least one elongate element that are adapted to correspond to a plurality of finger joints of a wearer when worn, wherein each bending area comprises a bendable dome-shaped curvature; and a plurality of substantially rigid interconnecting areas disposed along the at least one elongate element that are adapted to correspond to a plurality of finger bone segments that extend between the plurality of finger joints of the wearer when worn, wherein each of the plurality of substantially rigid interconnecting areas is integrally coupled to at least one of the plurality of bending areas and comprises:

a gutter-shaped curvature having an inner surface and an outer surface, wherein the inner surface is adapted to extend along a length of a backside surface of one of the plurality of finger bone segments and is adapted to extend laterally around sides of one of the plurality of finger bone segments of the wearer when worn; and at least one rib located on the outer surface of the gutter-shaped curvature and shaped to extend along the length of the outer surface without extending across the at least one of the plurality of bending areas integrally coupled to each of the plurality of substantially rigid interconnecting areas.

2. The reinforcing element of claim 1, wherein the at least one rib is configured to resist bending.

3. The reinforcing element of claim 1 configured for use in a glove, wherein the reinforcing element comprises a length suitable to extend substantially from a backside of a wearer's hand to an end of a finger.

4. The reinforcing element of claim 3, wherein the reinforcing element extends beyond the end of the finger.

5. The reinforcing element of claim 1, wherein the reinforcing element is made as a single piece.

6. The reinforcing element of claim 1, wherein the reinforcing element is made by multi-component injection molding of at least two different plastic materials.

7. The reinforcing element of claim 1, wherein the reinforcing element comprises at least one of a material and a coating adapted to enable sliding of the reinforcing element within a receptacle of the article of clothing.

8. The reinforcing element of claim 1 further comprising a releasably mounted weight.

9. The reinforcing element of claim 8, wherein the releasably mounted weight is releasably mounted to the reinforcing element.

10. The reinforcing element of claim 8, wherein the releasably mounted weight is disposed proximate an end of the reinforcing element.

11. The reinforcing element of claim 1, further comprising at least one aperture formed in at least one of the plurality of bending areas and the plurality of substantially rigid interconnecting areas.

12. The reinforcing element of claim 1, wherein the at least one elongate element provides a restoring force when bent in the first direction.

13. An article of clothing comprising a reinforcing element configured for bending in a first direction and resisting bending in a second direction, the reinforcing element comprising:

at least one elongate element;

a plurality of bending areas disposed along the at least one elongate element that are adapted to correspond to a plurality of finger joints of a wearer when worn, wherein each bending area comprises a bendable dome-shaped curvature; and a plurality of substantially rigid interconnecting areas disposed along the at least one elongate element that are adapted to correspond to a plurality of finger bone segments that extend between the plurality of finger joints of the wearer when worn, wherein each of the plurality of substantially rigid interconnecting areas is integrally coupled to at least one of the plurality of bending areas and comprises:

a gutter-shaped curvature having an inner surface and an outer surface, wherein the inner surface is adapted to extend along a length of a backside surface of one of the plurality of finger bone segments and is adapted to extend laterally around sides of one of the plurality of finger bone segments of the wearer when worn; and at least one rib located on the outer surface of the gutter-shaped curvature and shaped to extend along the length of the outer surface without extending across the at least one of the plurality of bending areas integrally coupled to each of the plurality of substantially rigid interconnecting areas, wherein the article comprises a glove.

14. The article of clothing of claim 13, wherein the reinforcing element is removably disposed within a receptacle of the article of clothing.

15. A reinforcing element for an article of clothing configured for bending in a first direction and resisting bending in a second direction, the reinforcing element comprising:

at least one elongate element;

a plurality of bending areas disposed along the at least one elongate element, wherein each bending area is adapted to correspond to a finger joint of a wearer when worn and comprises a bendable dome-shaped curvature; and a plurality of substantially rigid interconnecting areas disposed along the at least one elongate element, wherein each substantially rigid interconnecting area is adapted to correspond to a finger bone segment that extends from the finger joint of the wearer when worn, wherein each of the plurality of substantially rigid interconnecting areas is integrally coupled to at least one of the plurality of bending areas and comprises:

a gutter-shaped curvature having an inner surface and an outer surface, wherein the inner surface is adapted to extend along a length of a backside surface of the finger bone segment and is adapted to extend laterally around sides of the finger bone segment of the wearer when worn; and at least one rib located on the outer surface of the gutter-shaped curvature and shaped to extend along the length of the outer surface without extending across the at least one of the plurality of bending areas integrally coupled to each of the plurality of substantially rigid interconnecting areas, wherein the article of clothing comprises a glove comprising at least one finger, wherein the at least one elongate element is positioned adjacent the at least one finger of the glove, and the glove further comprises an element corresponding to a backside of a hand.

16. The article of clothing of claim 15, wherein the reinforcing element is releasably attached to the elongate element.

17. The article of clothing of claim 15, wherein the element for the backside of the hand comprises a plate.

18. A reinforcing element for an article of clothing configured for bending in a first direction and resisting bending in a second direction, the reinforcing element comprising:

at least one elongate element;

a plurality of bending areas disposed along the at least one elongate element that are adapted to correspond to a plurality of joints of a wearer when worn, wherein each bending area comprises a bendable dome-shaped curvature; and a plurality of substantially rigid interconnecting areas disposed along the at least one elongate element that are adapted to correspond to a plurality of bone segments that extend between the plurality of joints of the wearer when worn, wherein each of the plurality of substantially rigid interconnecting areas is integrally coupled to at least one of the plurality of bending areas and comprises:

a gutter-shaped curvature having an inner surface and an outer surface, wherein the inner surface is adapted to extend along a length of a backside surface of one of the plurality of bone segments and is adapted to extend laterally around sides of one of the plurality of bone segments of the wearer when worn; and at least one rib located on the outer surface of the gutter-shaped curvature and shaped to extend along the length of the outer surface without extending across the at least one of the plurality of bending areas integrally coupled to each of the plurality of substantially rigid interconnecting areas.

* * * * *